US005675109A

United States Patent [19]

Maher

[11] Patent Number: 5,675,109

[45] Date of Patent: Oct. 7, 1997

[54] PASSIVE AMMUNITION MAGAZINE FOR COMBAT VEHICLES

[75] Inventor: David Lord Maher, Burlington, Vt.

[73] Assignee: Lockheed Martin Corporation, Bethesda, Md.

[21] Appl. No.: 609,708

[22] Filed: Mar. 1, 1996

[51] Int. Cl.[6] ..... F41A 9/00

[52] U.S. Cl. ..... 89/33.01; 89/33.1; 89/45; 89/46

[58] Field of Search ..... 89/33.01, 33.1, 89/45, 46

[56] References Cited

U.S. PATENT DOCUMENTS

| | | | |
|---|---|---|---|
| 3,075,434 | 1/1963 | Hickman et al. | 89/46 |
| 4,481,862 | 11/1984 | Wiethoff et al. | 89/46 |
| 4,947,728 | 8/1990 | Muhlhausen et al. | 89/46 |
| 5,022,308 | 6/1991 | Heldman et al. | 89/45 |
| 5,289,754 | 3/1994 | Elspass | 89/46 |

*Primary Examiner*—J. Woodrow Eldred
*Attorney, Agent, or Firm*—Finnegan, Henderson, Farabow, Garrett & Dunner, L.L.P.

[57] ABSTRACT

A passive ammunition magazine includes a plurality of cells arranged in rows for accommodating projectiles in vertical, base-down orientations on cell base supports. Each cell includes a pair of vertically spaced locking members mounted at one side of the cell for pivotal movement between lower release positions and upper locking positions with cradle-shaped forward edges frictionally engaging the projectile body. An operator, linked to the locking members, is acted upon by a projectile-supporting foot of an upload/download transfer mechanism to produce the locking member pivotal movements. In their locking positions, the locking members are oriented at angles less than 45° relative to horizontal, and, in response to upward motion of the projectile, pivot upwardly to wedge the projectile against fixed backing members positioned at the opposite side of the cell.

14 Claims, 5 Drawing Sheets

PASSIVE AMMUNITION MAGAZINE FOR COMBAT VEHICLES

FIELD OF THE INVENTION

The present invention relates to ammunition storage facilities and particularly to magazines suitable for installation in combat and resupply vehicles.

BACKGROUND OF THE INVENTION

Ammunition magazines for storing large caliber rounds of ammunition, such as those fired by howitzers, are generally of two types, active and passive. Active magazines include an internal ammunition conveyor that must be driven to upload ammunition rounds into the magazine for storage and then driven again to successively download the ammunition rounds.

A passive magazine, on the other hand, is designed to provide a plurality of cells where the ammunition rounds (projectiles) are stored in fixed positions. A robotic transfer mechanism is then designed to enter the magazine and traverse to each cell in succession to upload and download projectiles.

A design consideration common to both magazine types is safely securing the projectiles in their magazine storage positions. When the magazines are installed in combat vehicles, travel over rough terrain subjects the projectiles to shock loads that can dislodge them from their magazine storage positions. Furthermore, the magazine must be designed to relax the restraints on the projectiles, such that they can be readily uploaded and downloaded in rapid fashion.

SUMMARY OF THE INVENTION

It is accordingly an objective of the present invention to provide an improved passive ammunition magazine, wherein the projectiles are effectively locked in their magazine cells incident to uploading by a robotic transfer mechanism and readily unlocked or released incident to downloading by the transfer mechanism.

An additional objective of the present invention is to provide an improved passive magazine having the above features, that is economical to manufacture, readily adapted to combat and resupply vehicles, and efficient and reliable in operation over a long service life.

Additional features and advantages of the invention will be set forth in the description that follows, and, in part, will be apparent from the description, or may be learned from practice of the invention. The objectives and other advantages of the invention will be realized and attained by the apparatus particularly pointed out in the written description and claims hereof, as well as the appended drawings.

To achieve these and other objectives, and in accordance with the purpose of the present invention as embodied and broadly described, a passive ammunition magazine is provided with a plurality of cells respectively for accommodating projectiles wherein each cell comprises: an open end through which projectiles may be uploaded and downloaded; a closed end against which a base end is positioned while stowed in the cell; a backing member positioned at one side of the cell proximate the projectile while resting on the base support; a locking member located at an opposite side of the cell and mounted for pivotal movement between a release position and a locking position, the locking member, while in the locking position, frictionally engaging the projectile body and acting to wedge the projectile against the backing member in response to motion of the projectile toward the open end of the cell; and an operator linked to pivot the locking member between the release and locking positions.

It is to be understood that the foregoing general description and the following detailed description are exemplary and explanatory and are intended to provide further explanation of the invention defined in the appended claims.

BRIEF DESCRIPTION OF THE DRAWINGS

The accompanying drawings, which are incorporated in and constitute a part of this specification, illustrate embodiments of the invention and, together with the following detailed description, serve to explain the objectives, advantages, and principles of the invention.

In the drawings:

FIGS. 10*a*–12*a* and FIGS. 10*b*–12*b* are respective plan and side elevational views illustrating a series of operating positions of a coordinating mechanism, according to an embodiment of the invention, for coordinating operations of the magazine cell illustrated in FIGS. 5, 6, 8, and 9 with operations of a projectile gripper in a robotic ammunition transfer mechanism.

Like reference numerals refer to corresponding parts in the various figures of the drawings.

DETAILED DESCRIPTION OF THE INVENTION

Figure 1:
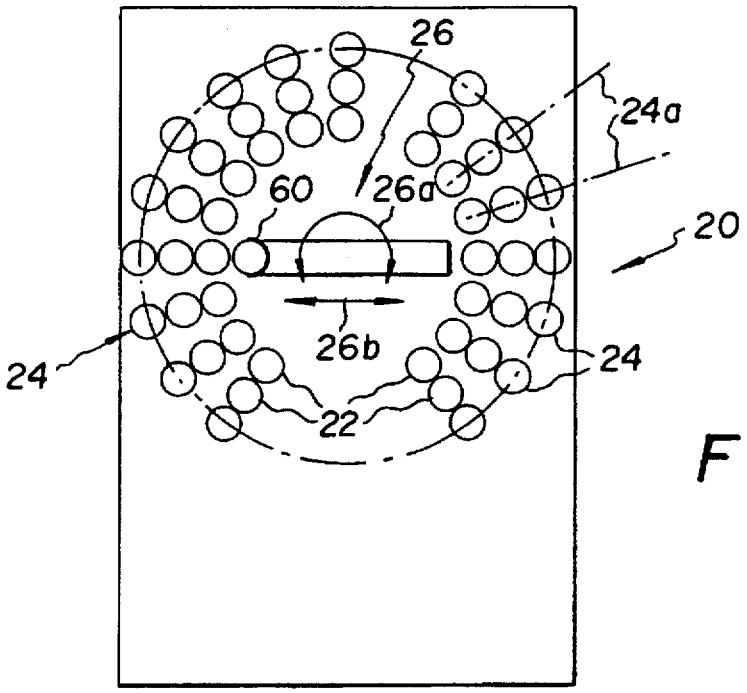
FIGS. 1 and 2 are schematic illustrations of alternative layouts of passive ammunition magazines to which the present invention may be adapted.

In the layout of a passive ammunition magazine, generally indicated at 20 in the schematic illustration of FIG. 1, a plurality of ammunition rounds or projectiles 22, such as howitzer rounds, stored in vertical, base down orientations, are arranged in a circular array including a plurality of angularly spaced, radial rows 24 of projectiles. The central portion of magazine 20 is open to provide space for a robotic transfer mechanism, generally indicated at 26, operable to rotate, as indicated by arrow 26*a*, into positions aligned with centerlines 24*a* of the rows 24 and then to move linearly, as indicated by arrow 26*b*, in and out along the row axes to pick up projectiles 22 for downloading from a resupply vehicle to a combat vehicle or downloading to a cannon (not shown) of a combat vehicle and the like.

Figure 2:
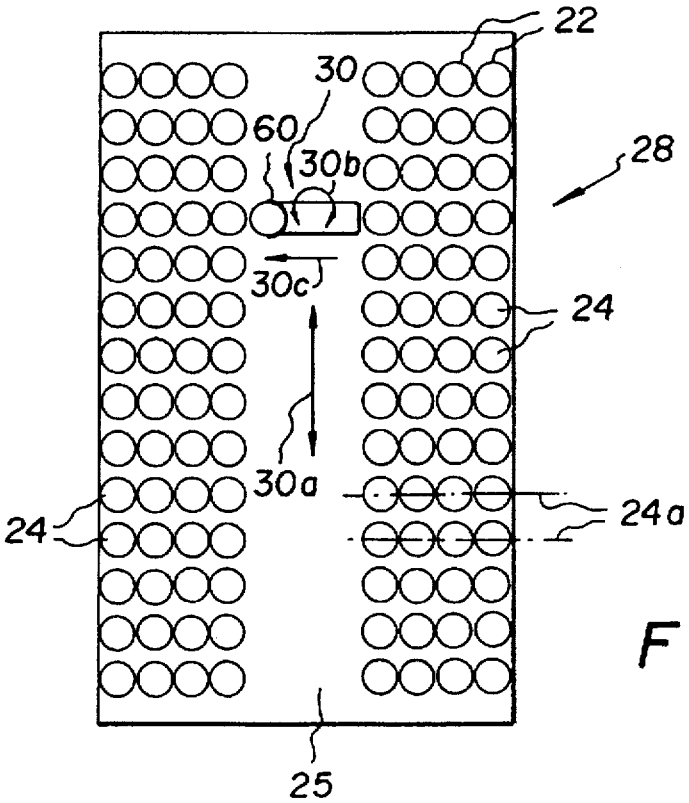

In the alternative layout schematically illustrated in FIG. 2, a passive magazine, generally indicated at 28, the projectiles 22 are arranged in left and right banks of rows 24 separated by a center aisle 25. A robotic transfer mechanism 30 moves through the aisle 25, as indicated by arrow 30*a*, into alignment with the centerlines 24*a* of rows 24, rotates, as indicated by arrow 30*b* to address either the right or left banks of rows, and moves in and out along the row centerlines, as indicated by arrow 30*c*, to pick up projectiles 22 for downloading.

Figure 3:
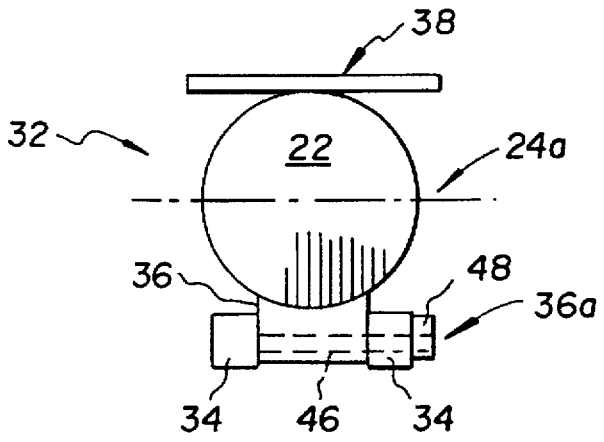
FIG. 3 is a plan view of a passive magazine cell, structured in accordance with one embodiment of the invention and having utility in the passive magazines of FIGS. 1 and 2.
Figure 4:
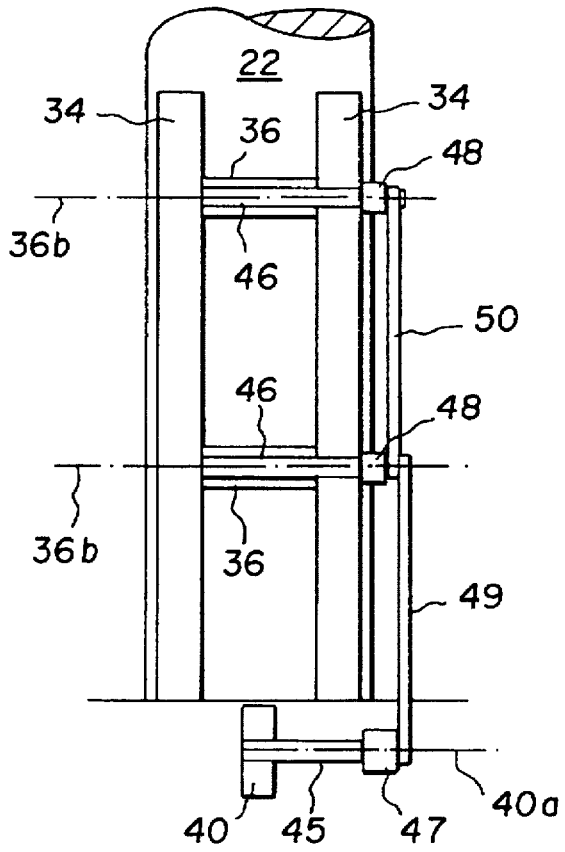
FIG. 4 is a side elevational view of the magazine cell of FIG. 3.
Figure 5:
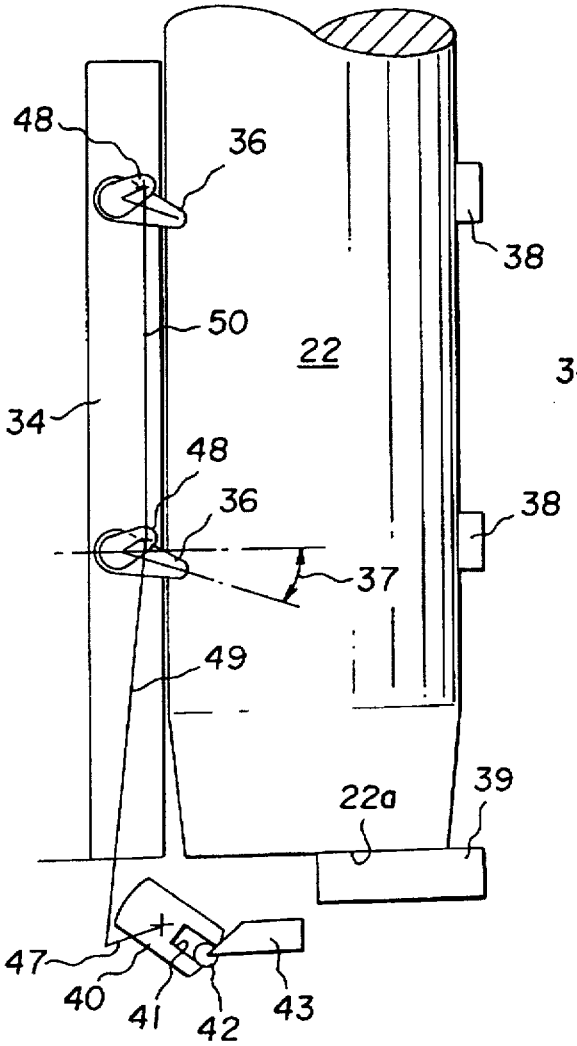
FIGS. 5 and 6 are side elevational views of the magazine cell of FIG. 3 shown in respective closed-cell and open-cell conditions.
Figure 6:
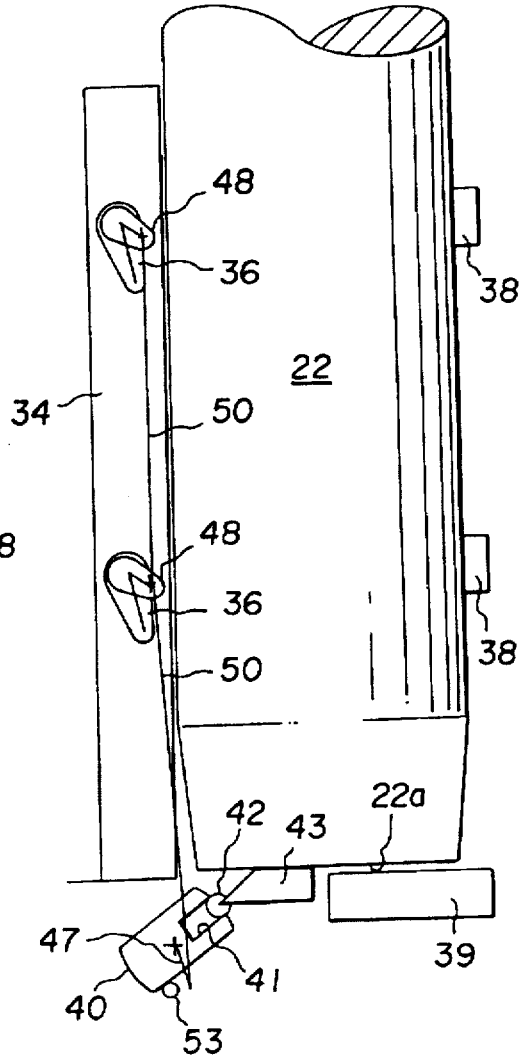

Accordingly to one embodiment of the invention, the projectiles 22 in the magazines of FIGS. 1 and 2, are securely stowed in rows of cells, one generally indicated at 32 in FIG. 3. As also seen in FIG. 4, each cell includes a pair of laterally spaced posts 34 that serve to pivotally mount between them a pair of vertically spaced locking members 36 in positions to one side of a row centerline 24*a*. Preferably, each adjacent pair of cells 32 share a common post 34. The locking members of each cell are pivotable about respective horizontal axes 36*b* extending parallel to the row centerline 24*a*. As seen in FIGS. 3, 5 and 6, each cell 32 also includes a pair of rigid backing members 38 positioned on the opposite side of the row 24 from the locking members 36 at heights compatible with the positions of the locking members. The spacing across the cell between its posts 34 and backing members 38 is slightly in excess of the diameter of a projectile 22 supported in vertical, base-down orientation on a base support 39 seen in FIGS. 5 and 6.

To jointly pivot the locking members 36 between an upper locking (cell-closed) position, seen in FIG. 5, engaging projectile 22 in its cell 32, and a lower release (cell-open) position, seen in FIG. 6, freeing the projectile for pickup by a robotic transfer mechanism (not shown), each cell further includes an operator 40. In this embodiment of the invention, operator 40 may take the form of an elongated tongue mounted at one end for rotation about a horizontal axis 40*a* seen in FIG. 4. The free end of tongue 40 is provided with an inwardly extending slot 41 for receiving a toe 42 of a foot 43 included with the robotic transfer mechanisms 26 of FIG. 1 or 30 of FIG. 2.

As seen in FIG. 5, slot 41 is obliquely angled upwardly, when cell 32 is closed (projectile locked), and is obliquely angled downwardly, as seen in FIG. 6, when the cell is open (projectile released) for projectile uploading or downloading by the robotic transfer mechanisms. FIG. 6 illustrates the cell in an open condition, and a projectile 22, in the grasp of the transfer mechanism and centered in the cell, in the initial stage of downloading the cell or in concluding stage of uploading of the cell. It is seen that the projectile base 22*a* is resting on robotic foot 43 in a position elevated slightly above base support 39, and thus the projectile is free to enter or leave the cell. Assuming the transfer mechanism has uploaded the projectile to the centered cell position and, incident thereto, toe 42 has entered tongue slot 41, when foot 43 descends to the position seen in FIG. 5 to drop the projectile off onto cell base support 39, tongue 40 is forcibly pivoted to its cell closed orientation. The transfer mechanism can then back out of the row to begin uploading the next projectile.

On the other hand, when the transfer mechanism operates to download a projectile from a cell, its foot 43 enters the row to the cell at the lower level seen in FIG. 5, such that its toe enters slot 41 in the tongue 40 residing in its closed-cell orientation. Then, when foot 42 is raised to lift the projectile off of the cell base support 39, the tongue is rotated to its open-cell orientation seen in FIG. 6.

Turning to FIG. 4, tongue 40 is fixed on a shaft 45 journaled by suitable magazine support structure (not shown), while locking members 36 are fixed on respective shafts 46 rotatably mounted by posts 34. A crank 47 is keyed on one end of tongue shaft 45, and cranks 48 are keyed on extensions of locking member shafts 46. A first elongated link 49 is pivotally connected at its lower end to crank 47 and at its upper end to the lower one of the locking member cranks 48. A second elongated link 50 is pivotally connected at its ends to the upper and lower locking member cranks 48. It is seen that, by virtue of this linkage arrangement (also indicated schematically in FIGS. 5 and 6), the locking members 36 are jointly pivoted between their upper, locking positions and their lower, release positions by upward and downward movements of the transfer mechanism foot 43 acting via tongue 40.

In accordance with a feature of the present invention, each locking member 36 may be in the form of a plate, as best seen in FIG. 3, that is fixedly mounted to shaft 46 along its rearward edge. The forward edge 36*a* of each locking member that faces the cell 32 is contoured to provide an arcuate edge surface lying on a radius closely corresponding to the projectile body radius. The depth of each locking member between its forward edge and shaft 46 is such that, when oriented horizontally, the separation between its arcuate, cradle-shaped edge 36*a* and a horizontally opposed backing member 38 is less than the projectile diameter. Thus, when the locking members 36 assume their locking (cell-closed) positions, frictionally engaging the projectile periphery, they are angularly oriented at angles 37 less than 45° to horizontal, as best seen in FIG. 5. Any vertical motion of the projectile in the cell is therefore accompanied by incremental, upward pivotal movements of the locking members effective to wedge the projectile against backing members 38. Moreover, by virtue of the cradling nature of the locking member edges 36*a* with the projectile along arcuate portions of the projectile periphery, toppling motion of the projectile is effectively restrained. Thus, by virtue of the present invention, the projectiles 22 are effectively wedge-locked in the magazine cells 32 against shock loads tending to dislodge them from their cells. While fixed backing members 38 are illustrated, it will be appreciated that they may take the form of a duplicate set of locking members that are pivoted between locking and release positions in coordination with locking members 36.

Figure 7:
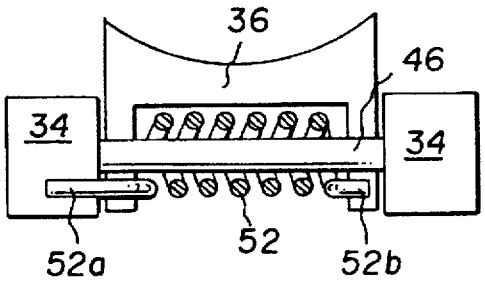
FIG. 7 is a fragmentary plan view of one of the locking members included in the magazine cell of FIGS. 3–6.

In accordance with another feature of the present invention, seen in FIG. 7, a torsion spring 52 is assembled on shaft 46, with one end 52*a* hooked to one of the mounting posts 46 and the other end hooked to the locking member 36. These torsion springs act to bias the locking members in the counterclockwise direction and thus ensure their engagements with the projectile periphery when pivoted to their locking positions by tongue 40. At the same time, these torsion springs, acting through links 49 and 50, also sustain a precise closed-cell angular orientation of the tongue, as seen in FIG. 5, when released by the robot foot 43. This is important to ensure that slot 41 is properly positioned to receive the toe 42 of the robot foot 43 when the transfer mechanism returns to download the projectile from a cell.

When the transfer mechanism foot rotates tongue 40 to its open-cell orientation seen in FIG. 6 and thereby positions the locking members 36 in the lower, release positions, the torsion springs 52 continue to bias the locking members in the counterclockwise direction. This spring bias is seen to also pull upwardly on links 49 and 50 and thus exert a counterclockwise torque on tongue 40. When the toe 42 of the transfer mechanism is withdrawn from tongue slot 42, tongue 40 is rotated incrementally in the clockwise direction into engagement with a stop pin 53 by the torsion springs 52 to thus establish a precise open-cell tongue orientation. It is seen from FIG. 6 that link 49 and actuator crank 47 provide a toggle linkage that is overcentered to the right of the pivot axis 40*a* of tongue 40, and thus the torsion springs become effective to hold the actuator 40 against stop 53 and reliably sustain a detented, precise open-cell tongue orientation with slot 41 properly positioned to receive the toe 42 of foot 43 when the transfer mechanism returns to upload a projectile into the cell.

Figure 9:
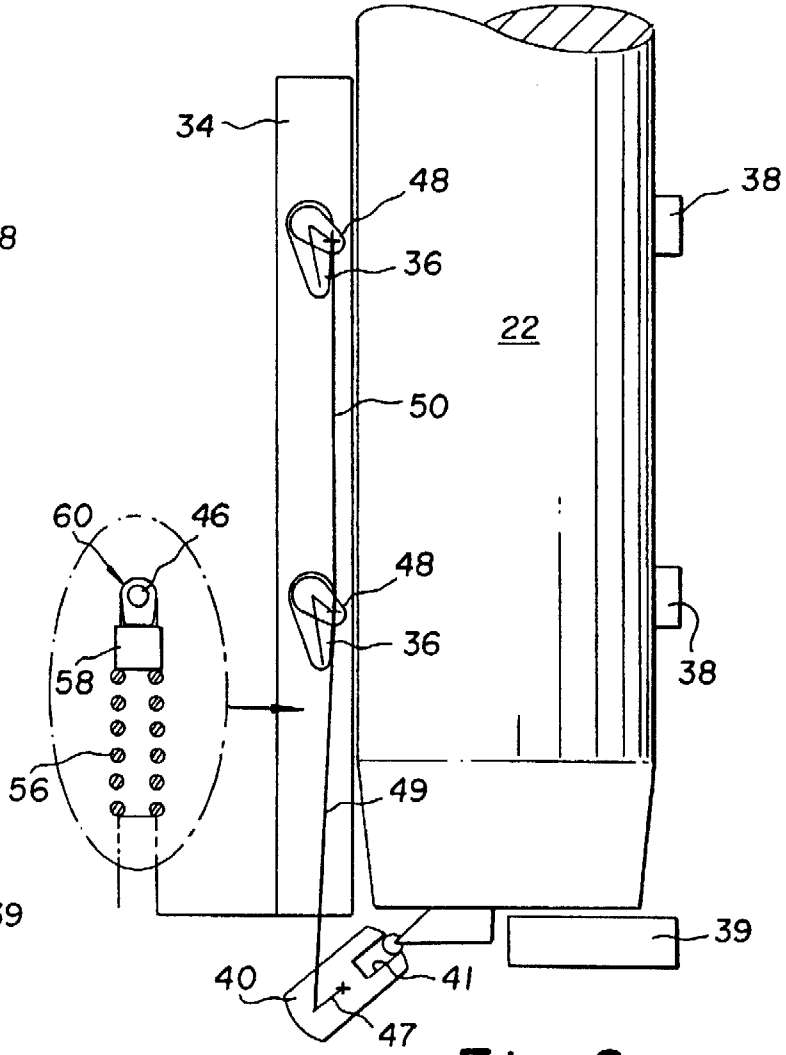
FIGS. 8 and 9 are side elevational views illustrating alternative detenting structure for releasably locking the magazine cell in its respective closed-cell and open-cell conditions.
Figure 8:
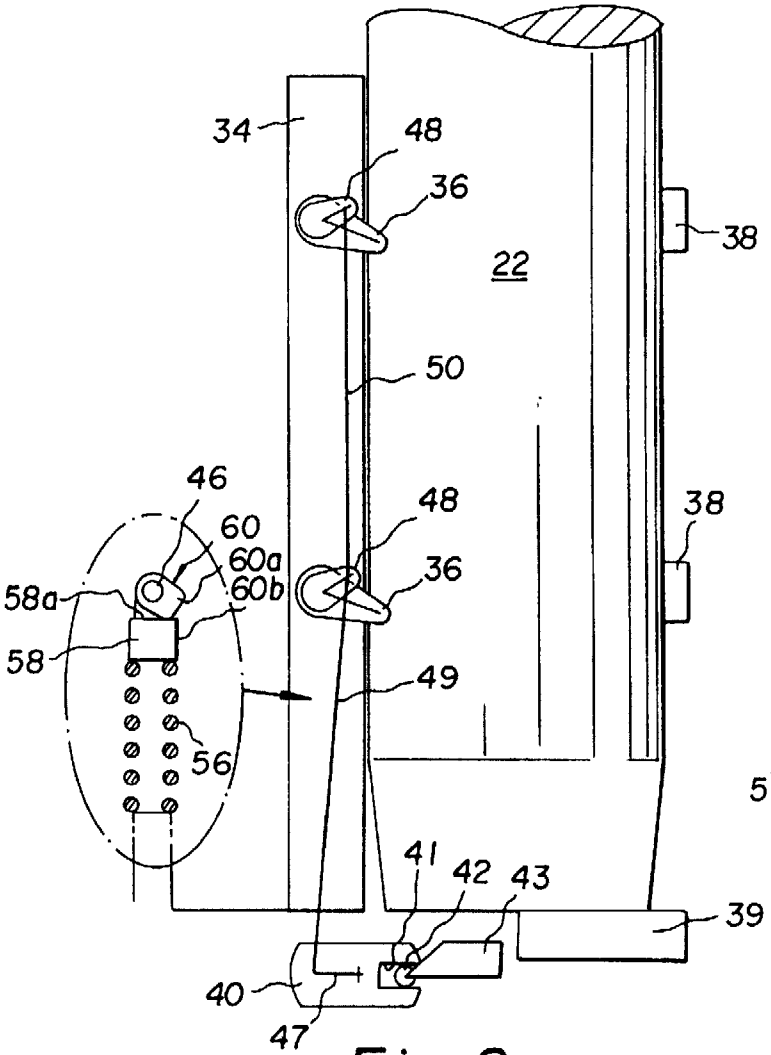

FIGS. 8 and 9 illustrate an alternative detenting embodiment for sustaining the open and closed-cell orientations of tongue 40, as well as open- and closed-cell positions of the locking members 36. Instead of torsion springs 52, a compression spring 56 is incorporated in one of the posts 34. This compression spring exerts an upward force on a slider 58 that acts against a cam 60 fixed on one of the locking member shafts 46. This cam 60 includes a flat-top lobe 60*a* that is engaged by the flat upper surface 58*a* of the slider 58 when the locking members 36 are pivoted to their lower, release positions by operator tongue 40. Consequently, locking members 36 are resiliently detented in their release positions, as is tongue 40 resiliently detented in its open-cell orientation, seen in FIG. 9.

When robot foot 43 acts via tongue 40 to pivot locking members 36 to their locking positions engaging the projectile periphery, cam 60 assumes the angular orientation seen in FIG. 8, such that spring 56 biases the flat surface 58*a* of slider 58 against a corner 60*b* of the cam. Consequently, locking members 36 are then resiliently detented in their locking positions, as is tongue 40 in its open-cell orientation.

FIGS. 10*a*, 10*b*, 11*a*, 11*b*, 12*a*, and 12*b* illustrate how the operation of a robotic transfer mechanism, such as schematically illustrated at 26 in FIG. 1 and at 30 in FIG. 2, may be coordinated with the opening and closing of a cell 32 to upload and download a projectile 22. Reference numeral 60 in these figures and in FIGS. 1 and 2 indicates a projectile gripper suitably adapted to the front end of the transfer mechanism. This gripper includes a pair of opposed fingers 62 arcuately shaped to conform to the projectile periphery. Corresponding rearward ends of these fingers 62 are pivotally mounted on vertical pins 63 fixed to the transfer mechanism. Rearward extensions 64 of fingers 62 are interconnected by a toggle linkage consisting of a link 65 pivotally connected at one end to one finger extension 64, as indicated at 65*a*, and a link 66 pivotally connected to the other finger extension 64, as indicated at 66*a*. The other ends of links 65, 66 are pivotally interconnected by a toggle pin 67. The upper end of an operating link 68 is pivotally connected to the toggle pin 67, and a cam follower 69 is carried at the lower end of the operating link 68. This cam follower 69 runs in a cam track 70 formed in a vertical surface of a cam 71 that is fixed on a horizontal shaft 72 driver by the transfer mechanism. Also running in cam track 70 is a cam follower 73 carried at the upper end of a vertical extension 43*a* of robotic foot 43, also illustrated in FIGS. 5 and 6.

Figure 10A:
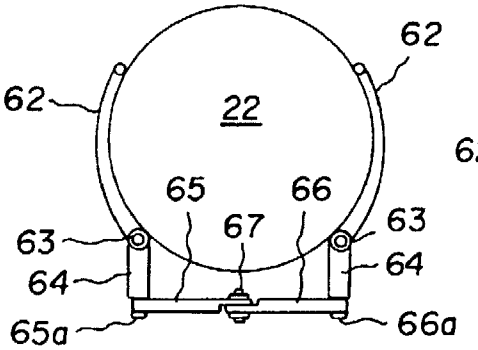
Figure 10B:
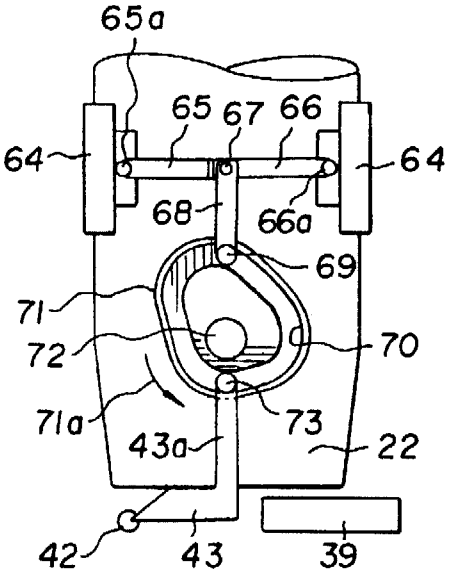

FIGS. 10*a* and 10*b* correspond to FIG. 6 in their depictions of a projectile 22 centered in a cell 32 while in the grasp of gripper 60 and resting on foot 43 with its base 22*a* spaced above base support 39. In the angular orientation of cam 71 illustrated in FIG. 10*b*, the configuration of the upper portion of cam track 70 receiving cam follower 69 is such that operating link 68 is pushed upwardly to place toggle links 65, 66 in a straightened condition. As a result, fingers 62 are forcibly pivoted toward each other into tight gripping engagement with the projectile 22. At the same time, the configuration of the lower portion of cam track 70 receiving cam follower 73 is such that foot 43 is held in an elevated position to assist gripper 60 in holding projectile in the illustrated position spaced above base support 39.

Figure 11A:
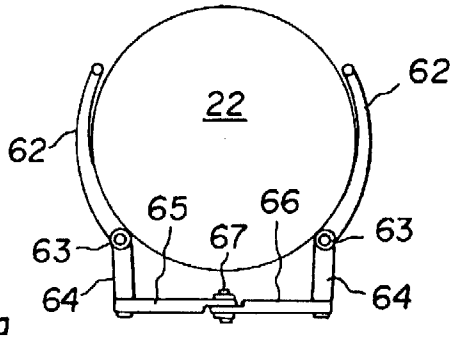
Figure 11B:
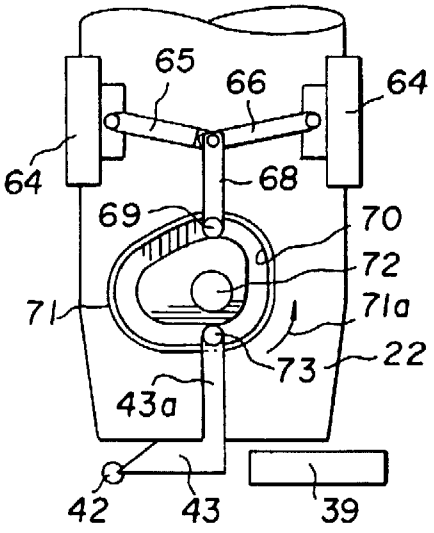

As cam 71 is rotated in the counterclockwise direction, indicated by arrow 71*a*, to the angular position illustrated in FIG. 11*b*, operating link 68 is progressively pulled downwardly to begin collapsing toggle links 65 and 66. It is seen that, as these toggle links progressively collapse, gripper fingers 62 are pivoted in parting directions to relax their grip on the projectile 22, as illustrated in FIG. 11*a*. In their relaxed condition, the gripper fingers 62 permit vertical motion of the projectile, while affording lateral (radial) restraint to maintain the vertical orientation of the projectile. It will be noted that the cam track configuration is such that foot 43 still remains held in an elevated position, and thus the entire projectile weight is now borne by foot 43.

Figure 12A:
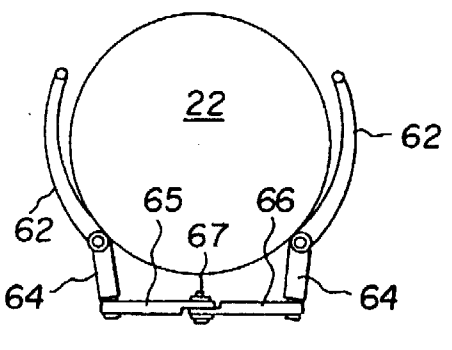
Figure 12B:
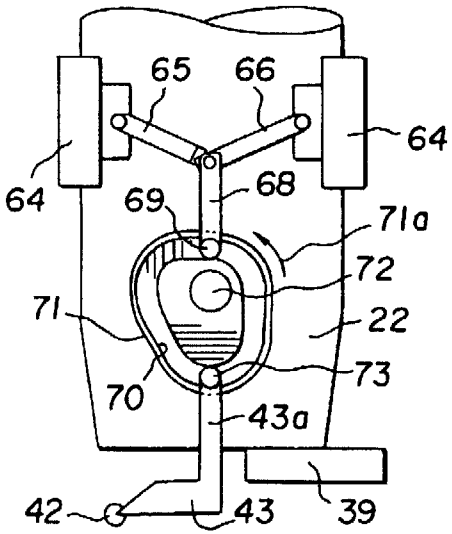

Continued counterclockwise rotation of cam 71 is seen, by virtue of the cam track configuration, to further collapse toggle links 65, 66, as seen in FIG. 12*a*, and to allow foot 43 to descend to the lower position seen in FIGS. 12*b* and 5, in the process dropping projectile off onto base support 39. With the toggle links fully collapsed, gripper fingers 62 are sufficiently parted such that gripper 60 may be withdrawn without disturbing the projectile resting on base support 39. It will be appreciated that the above-described operating sequence to upload a projectile into a cell is simply reversed to download a projectile from a cell.

Since it is foot 43 that motivates and controls the opening and closing of the cells, it is seen that the cam 71, by virtue of its cam track configuration, coordinates the actions of the gripper fingers 62 with the actions of the locking members 36 of the cells 32. Thus, adjustments in this coordination can be readily made by reconfiguring the cam track 70. Rather than a single cam and cam track, separate cams, one to control the gripper fingers 62 and another to control the cell locking members 36, may be driven off of shaft 72.

It will be apparent to those skilled in the art that various modifications and variations can be made in the passive ammunition magazine of the present invention and in the illustrated constructions thereof without departing from the scope or spirit of the invention. For example, while in the disclosed embodiments of the invention the projectiles are stowed in the passive magazine cells in vertical, base down orientations, the cells may be oriented horizontally, such that the projectiles are stowed horizontally. The locking members would then act to wedge-lock the projectiles in the cells in response to lateral shock loadings on the projectiles. Moreover, the cradling action of the locking members and the resulting lateral restraint imposed on vertical stowed projectiles may be sufficient, without the wedging action, to safely maintain the projectiles in their cells. It will also be appreciated that, rather than fixed backing members, they may take the form of additional locking members that are pivoted between locking and release positions in coordination with the pivoting locking members disclosed herein.

It is to be appreciated that use of the terms "horizontal" and "vertical" in the foregoing detailed description and the following claims is for the sake of convenience, based on the assumption that the vehicle, in which the passive magazine embodiments of the invention are installed, is on level terrain. In the practice of the invention, clearly this will not always be the case.

Other embodiments of the invention will be apparent to those skilled in the art from consideration of the specification and practice of the invention disclosed herein. It is therefore intended that the specification and drawings be considered as exemplary only, with the true scope and spirit of the invention being indicated by the following claims.

What is claimed is:

1. An ammunition magazine including a plurality of cells, each cell accommodating a projectile with a projectile axis in substantial coincidence with a cell centerline, each cell comprising:

a cradle member having a free end arcuately shaped in substantial conformance with a peripheral surface of the projectile, the cradle member mounted in laterally offset relation with the cell centerline for movement between a cell-open position and a cell-closed position with the arcuately shaped free end in cradling relation to the projectile peripheral surface;

means mounting the cradle member for pivotal movement about an axis normal to the cell centerline between the cell-open and cell-closed positions; and an operator linked to move the cradle member between the cell-open and cell-closed positions in response to actuation by a projectile upload/download transfer mechanism.

2. The ammunition magazine defined in claim 1, wherein each cell further includes a backing member positioned in laterally offset relation to and on an opposite side of the cell centerline from the cradle member, such that, while in the cell-closed position with the free end frictionally engaging the projectile peripheral surface, the cradle member pivots beyond the cell-closed position in response to cell-dislodging motion of the projectile to wedge the projectile against the backing member.

3. The ammunition magazine defined in claim 2, wherein the cell centerline is vertically oriented and each cell further includes a support upon which the projectile rests in vertical, base-down orientation, and wherein the cradle member in the cell-closed position assumes an angular orientation of less than 45° to horizontal and pivots beyond the cell-closed position toward the horizontal in response to upward cell-dislodging motion of the projectile.

4. An ammunition magazine including a plurality of cells for respectively accommodating projectiles in vertical, base down orientations, each cell comprising:

a support on which a projectile base may rest;

a backing member positioned at one side of the cell proximate a body of the projectile base support;

a locking member located at an opposite side of the cell from the backing member and mounted for pivotal movement between a lower release position and an upper locking position, the locking member, when in the locking position, frictionally engaging the projectile body and acting to wedge the projectile against the backing member in response to upward motion of the projectile; and an operator linked to pivot the locking member between the release and locking positions.

wherein the pivotal motion of the locking member from the release position to the locking position is in a direction toward the projectile, and the locking member assumes an angular orientation in the locking position of less than 45° relative to horizontal.

5. The ammunition magazine defined in claim 4, wherein the locking member is mounted for pivotal movement about a horizontal axis.

6. The ammunition magazine defined in claim 4, wherein the locking member includes a free end configured to frictionally engage the projectile body at multiple, circumferential locations.

7. The ammunition magazine defined in claim 4, wherein the locking member includes a free end of a cradle configuration so as to frictionally engage the projectile body along a circumferentially extending, essentially continuous contact line.

8. The ammunition magazine defined in claim 4, wherein each said cell includes a pair of horizontally spaced posts for pivotally mounting therebetween a vertically spaced pair of the locking members linked to the operator.

9. The ammunition magazine defined in claim 4, wherein the operator includes means accommodating engagement with a projectile transfer apparatus operative to motivate movements of the operator between open and closed-cell orientations and corresponding pivotal movements of the locking member between the release and locking positions.

10. The ammunition magazine defined in claim 9, wherein each cell further includes means for releasably detenting the operator in either of said open or closed-cell orientations in the absence of operative engagement of the operator by the projectile transfer apparatus.

11. The ammunition magazine defined in claim 10, wherein said detenting means includes a spring acting to exert a resilient position-detenting force on the locking member.

12. The ammunition magazine defined in claim 11, wherein said detenting means further includes a cam fixed on a pivotal mounting shaft for the locking member, the spring acting against the cam to exert the resilient position-detenting force on the locking member.

13. The ammunition magazine defined in claim 11, wherein the detenting means further includes a linkage interconnecting the operator and the locking member, the linkage including a toggle that assumes an overcentered condition when the operator is moved to the open-cell orientation established by a stop, the resilient position-detenting force of the spring acting to releasably detain the overcentered condition of the toggle and the operator biased against the stop.

14. An ammunition storage and retrieval apparatus comprising, in combination:

a magazine including a plurality of cells for accommodating projectiles in vertical, base-down orientations, each cell including:

a support on which a projectile base may rest;

a fixed backing member positioned at one side of the cell proximate a body of the projectile while resting on the base support;

a locking member located at an opposite side of the cell and mounted for pivotal movement about a horizontal axis between a lower release position and an upper locking position, the locking member, when in the locking position, frictionally engaging the projectile body and acting to wedge the projectile against the backing member in response to upward motion of the projectile; and an operator linked to pivot the locking member between the release and locking positions; and a traversing upload/download head including:

a gripper having opposed fingers mounted for pivotal movements in closing directions to grip a projectile and in opening directions to release the projectile, a toggle linkage interconnecting the opposed fingers and including a toggle pin, a first cam follower connected with the toggle pin, a foot movable between an upper position supporting the projectile in elevated relation to the cell support and a lower position below the cell support, the foot including a toe engagable with the cell operator and a second cam follower, and a cam engaging the first and second cam follower and driven by the upload/download head to coordinate the opening and closing directional movements of the gripper fingers with vertical movements of the foot between the upper and lower positions, whereby the locking member is controllably pivoted by the operator into the locking position in response to downward movement of the foot and is controllably pivoted into the release position in response to upward movement of the foot.

* * * * *